US008701739B2

(12) United States Patent
Coleman

(10) Patent No.: US 8,701,739 B2
(45) Date of Patent: Apr. 22, 2014

(54) PARTITION SYSTEMS INCLUDING TROLLEYS AND RELATED METHODS

(75) Inventor: W. Michael Coleman, Salt Lake City, UT (US)

(73) Assignee: Won-Door Corporation, Salt Lake City, UT (US)

( * ) Notice: Subject to any disclaimer, the term of this patent is extended or adjusted under 35 U.S.C. 154(b) by 164 days.

(21) Appl. No.: 13/042,091

(22) Filed: Mar. 7, 2011

(65) Prior Publication Data

US 2012/0227914 A1 Sep. 13, 2012

(51) Int. Cl.

| | |
|---|---|
| ***E05D 15/26*** | (2006.01) |
| ***A47H 5/00*** | (2006.01) |
| ***E06B 3/48*** | (2006.01) |
| ***E06B 3/94*** | (2006.01) |
| ***E06B 9/06*** | (2006.01) |

(52) U.S. Cl.
USPC ..... 160/199; 160/84.08

(58) Field of Classification Search
USPC ..... 160/84.01, 84.04, 84.05, 84.08, 199, 160/196.1, 126, 114; 16/91, 95 R, 95 D, 16/96 D, 97
See application file for complete search history.

(56) References Cited

U.S. PATENT DOCUMENTS 3,447,584 A * 6/1969 Smart ..... 160/84.08
4,133,364 A * 1/1979 Smart ..... 160/199
7,782,019 B2 8/2010 Banta et al.
8,336,597 B2 * 12/2012 Laraway et al. ..... 160/196.1
2008/0105387 A1 * 5/2008 Coleman et al. ..... 160/194
2011/0036016 A1 2/2011 Knight et al.

OTHER PUBLICATIONS

Coleman et al., U.S. Appl. No. 12/758,484, filed Apr. 12, 2010 entitled Methods, Apparatuses, and Systems for Movable Partitions.
Goodman, E. Carl, U.S. Appl. No. 12/838,235, filed Jul. 16, 2010 entitled Methods, Apparatuses, and Systems for Movable Partitions.

* cited by examiner

*Primary Examiner* — Katherine Mitchell
*Assistant Examiner* — Jeremy Ramsey
(74) *Attorney, Agent, or Firm* — TraskBritt

(57) ABSTRACT

Partition systems comprise a track and at least one partition configured to hang from and move along the track. A control box configured to contain at least a power supply for supplying power to a drive system, a floating jamb, and a trolley configured to attach to the floating jamb and rollingly engage with the track are also included. The trolley comprises at least one frame member comprising a jamb attachment portion configured to attach to the floating jamb, a distance from the jamb attachment portion to a rearmost surface of the at least one frame member opposite an end of the at least one frame member configured to face the at least one partition being less than or equal to a thickness of the control box in a direction at least substantially parallel to a direction of movement of the trolley. At least one support roller is attached to the at least one frame member and configured to engage with the track.

17 Claims, 6 Drawing Sheets

PARTITION SYSTEMS INCLUDING TROLLEYS AND RELATED METHODS

FIELD

Embodiments of the present disclosure relate generally to movable partition systems and related methods, and, more particularly, to trolleys that may provide connection between movable partitions and overhead tracks and that may be located in a pocket formed in a wall.

BACKGROUND

Movable partitions are utilized in numerous situations and environments for a variety of purposes. Such partitions may include, for example, foldable or collapsible doors configured to enclose or subdivide a room or other area. Often such partitions are utilized simply to subdivide a single large room within a building into multiple smaller rooms. The subdivision of a larger space may be desired, for example, to accommodate multiple groups or meetings simultaneously. Such partitions also may be used for noise control depending, for example, on the activities taking place in a given room or portion thereof.

Movable partitions may also be used to provide a security barrier, a fire barrier, or both a security barrier and a fire barrier. In such cases, the movable partition may be configured to close automatically on the occurrence of a predetermined event, such as actuation of an associated alarm. For example, one or more accordion or similar folding-type partitions may be used as a security barrier, a fire barrier, or both a security barrier and a fire barrier, wherein each partition includes a plurality of panels connected to one another with hinges. The hinged connection of the panels allows the partition to fold and collapse in a plicated manner into a compact unit for purposes of storage when not deployed. The partition may be stored in a pocket formed in the wall of a building when in a retracted or folded state. The depth of the pocket in a direction parallel to the movement of the partition may be determined by the size of the components disposed therein and the dimensions of the partition when in a retracted state.

When the partition is deployed to subdivide a single large room into multiple smaller rooms, secure an area during a fire, or for any other specified reason, the partition may be extended along a track, which may be an overhead track located above the movable partition on or in a header assembly, until the partition extends a desired distance across the room. The partition may be attached to a trolley that hangs from and rolls along the track. When deployed, a leading end of the movable partition, which may include or be defined by a component known as a "lead post," complementarily engages another structure, such as a wall, a post, or a lead post of another door.

The movable partition may be automatically extended and retracted using a motor that is conventionally located in the pocket formed in the wall of the building in which the movable partition is stored when in a retracted or folded state. The motor, which conventionally remains fixed in place within the pocket, may be used to drive extension and retraction of the movable partition. Controls for operating the motor, power supplies for supplying power to the motor, and other electrical components are also conventionally located in the pocket formed in the wall of the building in which the movable partition is stored when in a retraced or folded state.

BRIEF SUMMARY

In some embodiments, the present disclosure includes partition systems comprising a track and at least one partition configured to hang from and move along the track. The at least one partition has a leading first end and a second end opposite the first end. A drive system configured to move the at least one partition along the track, a control box configured to contain at least a power supply for supplying power to the drive system, and a floating jamb configured to attach to the second end of the at least one partition are also included. A trolley configured to attach to the floating jamb and rollingly engage with the track is included. The trolley comprises at least one frame member comprising a jamb attachment portion configured to attach to the floating jamb, a distance from the jamb attachment portion to a rearmost surface of the at least one frame member opposite an end of the at least one frame member configured to face the at least one partition being less than or equal to a thickness of the control box in a direction at least substantially parallel to a direction of movement of the trolley. At least one support roller is attached to the at least one frame member and configured to engage with the track.

In additional embodiments, the present disclosure includes trolleys comprising a frame member comprising a generally planar portion, roller attachment portions extending at right angles from the generally planar portion, and a jamb attachment portion extending at a right angle from the generally planar portion and transverse to the roller attachment portions, the jamb attachment portion being located three inches (3 in) or less from a rearmost surface of a trailing end of the frame member. A plurality of support rollers are attached to the roller attachment portions and have rotational axes oriented in an at least substantially horizontal direction. A plurality of guide rollers are attached to the roller attachment portions and have rotational axes oriented in an at least substantially vertical direction.

In still further embodiments, the present disclosure includes methods of installing a partition system comprising attaching at least one foldable partition to a floating jamb. The floating jamb is attached to a jamb attachment portion of a frame member of a trolley, the jamb attachment portion being located about three inches (3 in) or less from a rearmost surface of a trailing end of the trolley. The trolley is suspended from a track.

In further embodiments, the present disclosure includes methods of forming a trolley comprising forming a jamb attachment portion of at least one frame member to be located about three inches (3 in) or less from the rearmost surface of the frame member. At least one support roller having a rotational axis oriented in an at least substantially horizontal direction is attached to the at least one frame member. At least one guide roller having a rotational axis oriented in an at least substantially vertical direction is attached to the at least one frame member.

BRIEF DESCRIPTION OF THE DRAWINGS

While the specification concludes with claims particularly pointing out and distinctly claiming what are regarded as embodiments of the invention, various features and advantages of embodiments of the invention may be more readily ascertained from the following description of embodiments of the disclosure when read in conjunction with the accompanying drawings, in which:

DETAILED DESCRIPTION

Illustrations presented herein are not meant to be actual views of any particular device or system, but are merely idealized representations that are employed to describe embodiments of the present disclosure. Additionally, elements common between figures may retain the same numerical designation.

Embodiments of the present disclosure relate generally to systems, apparatuses, and methods for reducing the required depth of a pocket formed in a wall in which a movable partition system may be stored when in a retracted state. More particularly, embodiments of the present disclosure relate to trolleys that may be attached to a floating jamb of a partition system within a pocket and that may reduce the required depth of the pocket for storing the partition system in a retracted state.

Figure 1:
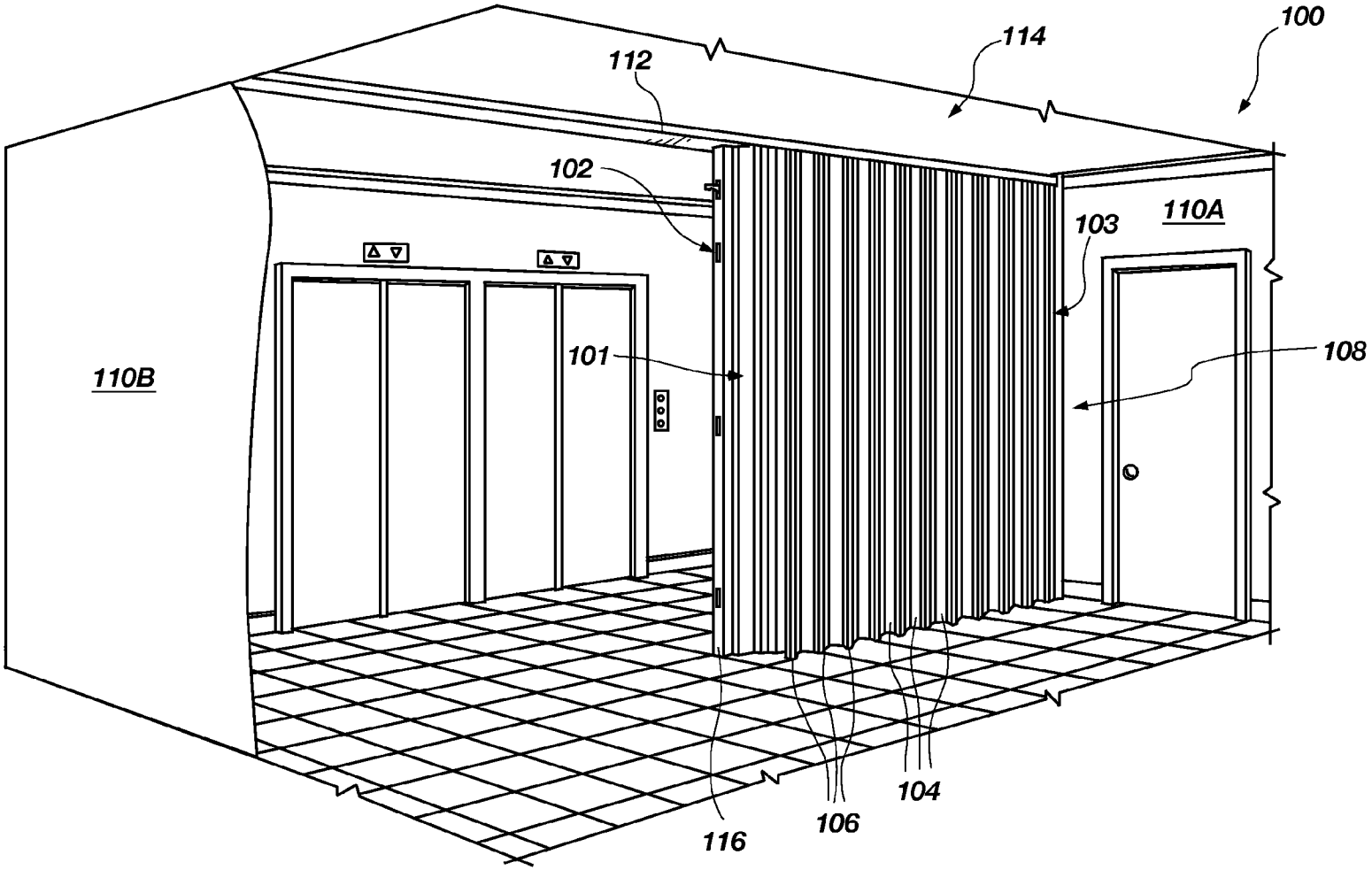
FIG. 1 is an illustration of a partition system.

In FIG. 1, a movable partition system 100 is shown. The movable partition system 100 may be an automatic movable partition system, in that the system 100 includes a movable partition 102 that may be automatically extended, automatically retracted, or both automatically extended and automatically retracted. As discussed in further detail below, the movable partition 102 also may be manually extended, manually retracted, or both manually extended and manually retracted. In other words, the movable partition system 100 may be moved both automatically and manually, as desirable. The movable partition 102 may be used for partitioning space, as a sound barrier, as a fire barrier, as a security barrier, for combinations of such purposes, or for other purposes.

The movable partition 102 may comprise, for example, an accordion-type folding door, as shown in FIG. 1. The movable partition 102 may include a plurality of panels 104 connected to one another with hinges or other hinge-like members 106. The hinged connection of the panels 104 enables the panels 104 to fold, and the movable partition 102 to collapse, in a plicated manner as the movable partition 102 is retracted, which enables the movable partition 102 to be stored compactly in a pocket 108 formed in a wall 110A of a building when in a retracted state. In other embodiments, the movable partition 102 may comprise a sliding door, or another type of movable partition 102.

When the movable partition 102 is deployed to an extended position, the movable partition 102 is driven along a track 112 across the space to provide an appropriate barrier. The track 112 may comprise an overhead track disposed in a header assembly 114. In such embodiments, the movable partition 102 may hang from and be movable along the track 112.

Figure 2:
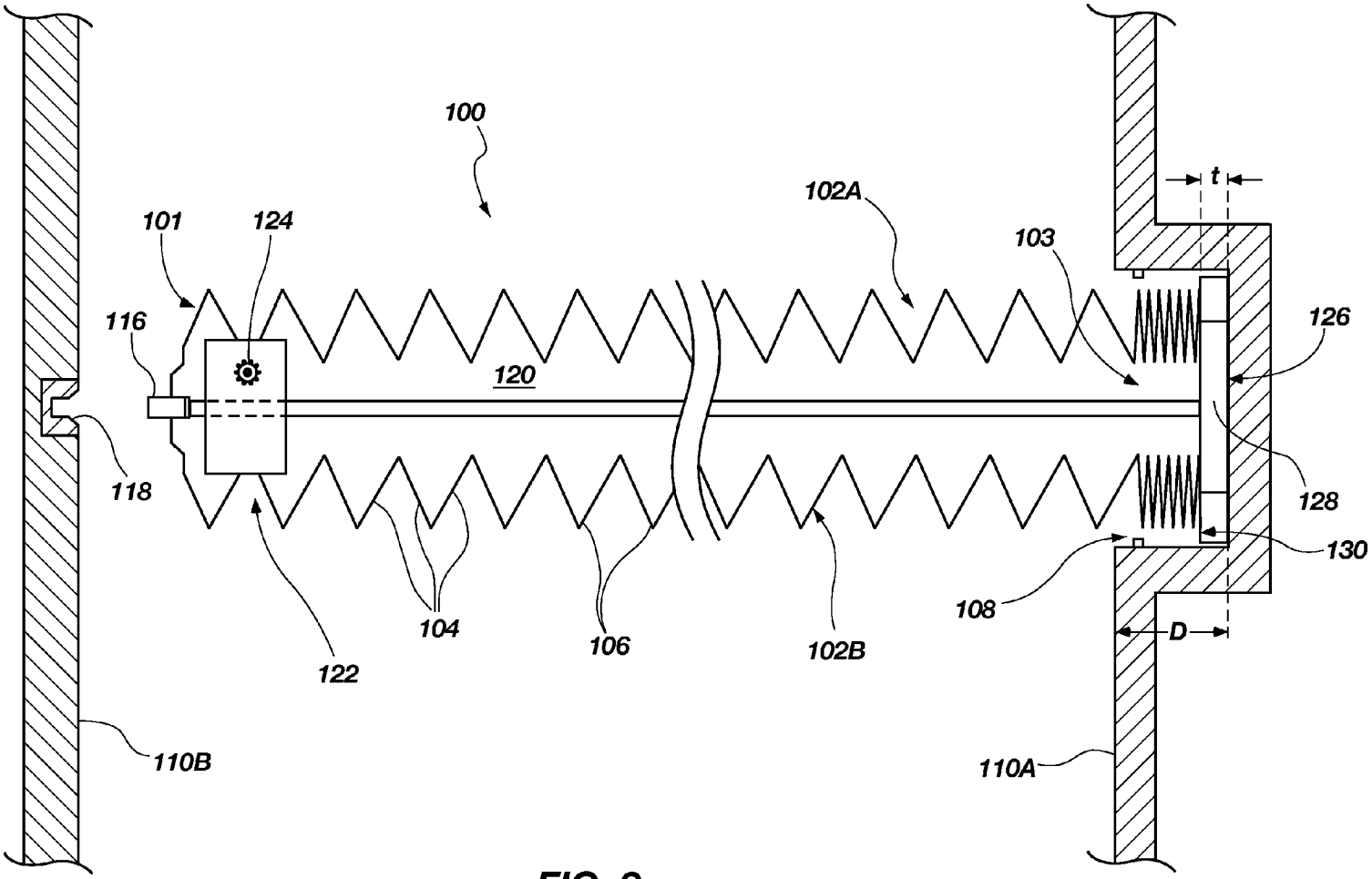
FIG. 2 is a simplified top view of the partition system of FIG. 1.

Referring to FIG. 2, a leading first end 101 of the movable partition 102, which may comprise a male lead post 116, may be configured to matingly (i.e., complementarily) engage with a door post 118 that may be formed in another wall 110B of a building when the movable partition 102 is deployed to an extended state. A second end 103 of the movable partition 102 may be located opposite the leading first end 101 and may be disposed in the pocket 108. In some embodiments, the male lead post 116 may matingly engage with a female lead post (not shown) of another movable partition (not shown), which may likewise be suspended from the track 112, conventionally known as a bi-part configuration. Such an additional movable partition with a female lead post (not shown) may also be configured to move automatically and/or manually.

The partition system 100 may include a first movable partition 102A and a second movable partition 102B laterally spaced from and extending substantially parallel to the first movable partition 102A. The leading first ends 101 of the first movable partition 102A and the second movable partition 102B may be attached at or near a lead post 116. Such a partition system 100 may be used, for example, as a fire door, wherein one movable partition 102A acts as a primary fire and smoke barrier, a space 120 between the first movable partition 102A and the second movable partition 102B acts as an insulator or a buffer, and the second movable partition 102B acts as a secondary fire and smoke barrier. Such a configuration may also be useful in providing an acoustic barrier when the partition system 100 is used to subdivide a larger space into multiple rooms.

In some embodiments, the partition system 100 may also include an automatic drive system 122. The drive system 122 may be disposed in the space 120 between the first movable partition 102A and the second movable partition 102B. The drive system 122 may be attached to and carried by the first and second movable partitions 102A and 102B, and may move cooperatively therewith as the first and second movable partitions 102A and 102B are extended or retracted. In some embodiments, all of the drive components of the partition system 100 may be confined between the first movable partition 102A and the second movable partition 102B.

The drive system 122 may be positioned near the lead post 116 of the partition system 100. The drive system 122 may include a motor (not shown) carried by the first and second movable partitions 102A and 102B as described in detail in U.S. patent application Ser. No. 12/542,448 which was filed Aug. 17, 2009 and is entitled "Methods, Apparatuses, and Systems for Driving a Movable Partition," in U.S. patent application Ser. No. 12/758,584, which was filed Apr. 12, 2010, now U.S. Pat. No. 8,365,796, issued Feb. 5, 2013, and is entitled "Methods, Apparatuses, and Systems for Movable Partitions," and in U.S. patent application Ser. No. 12/838,235, which was filed Jul. 16, 2010, now U.S. Pat. No. 8,443,866, issued May 21, 2013, and is entitled "Methods, Apparatuses, and Systems for Movable Partitions," the disclosure of each of which is hereby incorporated herein in its entirety by this reference. Briefly, the automatic drive system 122 may be configured to automatically open, automatically close, or to both automatically open and automatically close the movable partition 102 upon actuation thereof. The drive system 122 may include an elongated drive member (not shown), which, in some embodiments, may comprise, for example, a chain, belt, cable or rope having fixed ends. A rotatable drive member 124, such as, for example, a pulley, wheel, cog, or sprocket, may be configured to engage the elongated drive member such that when the rotatable drive member 124 is rotated, the rotatable drive member 124 moves along the elongated drive member causing the first and second movable partitions 102A and 102B to automatically extend to a deployed state or automatically retract to a collapsed state.

In other embodiments, the drive system 122 may comprise a motor or other actuator for extending a movable partition fixedly located in the pocket 108. For example, a drive system as disclosed in U.S. Pat. No. 7,782,019 issued Aug. 24, 2010 to Banta et al., the disclosure of which is incorporated herein in its entirety by this reference, may be used.

The partition system 100 may also include a control system 126. The control system 126 may be operatively coupled to the drive system 122 and may control, for example, actuation of the drive system 122 to extend and retract the first and second movable partitions 102A and 102B. The control system 126 may be located in a control box 128. The control system 126 may comprise, for example, a processor, a power supply, input and output ports, power ports, a battery system, switches, and other components for controlling the operation of a partition system 100 known in the art. A floating jamb 108 may be attached to the second end 103 of the movable partitions 102A and 102B and may be located within the pocket 108. The control box 128 may also be located within the pocket 108 on a side of a floating jamb 130 opposing the first and second movable partitions 102A and 102B. The control box 128 may have a thickness t in a direction at least substantially parallel to a direction of movement of the first and second movable partitions 102A and 102B. The thickness t of the control box 128 may be, for example, about three inches (3 in). For example, the thickness t of the control box 128 may be three percent greater or smaller (±3%) than three inches (3 in), five percent greater or smaller (±5%) than three inches (3 in), or even ten percent greater or smaller (+10%) than three inches (3 in). The thickness t of the control box 128 may form a portion of an overall depth D of the pocket 108 in which the partition system 100 may be stored when in a retracted state. In some embodiments, the thickness t of the control box 128 may be minimized to reduce the overall depth D of the pocket 108 required for storing the partition system 100.

Figure 3:
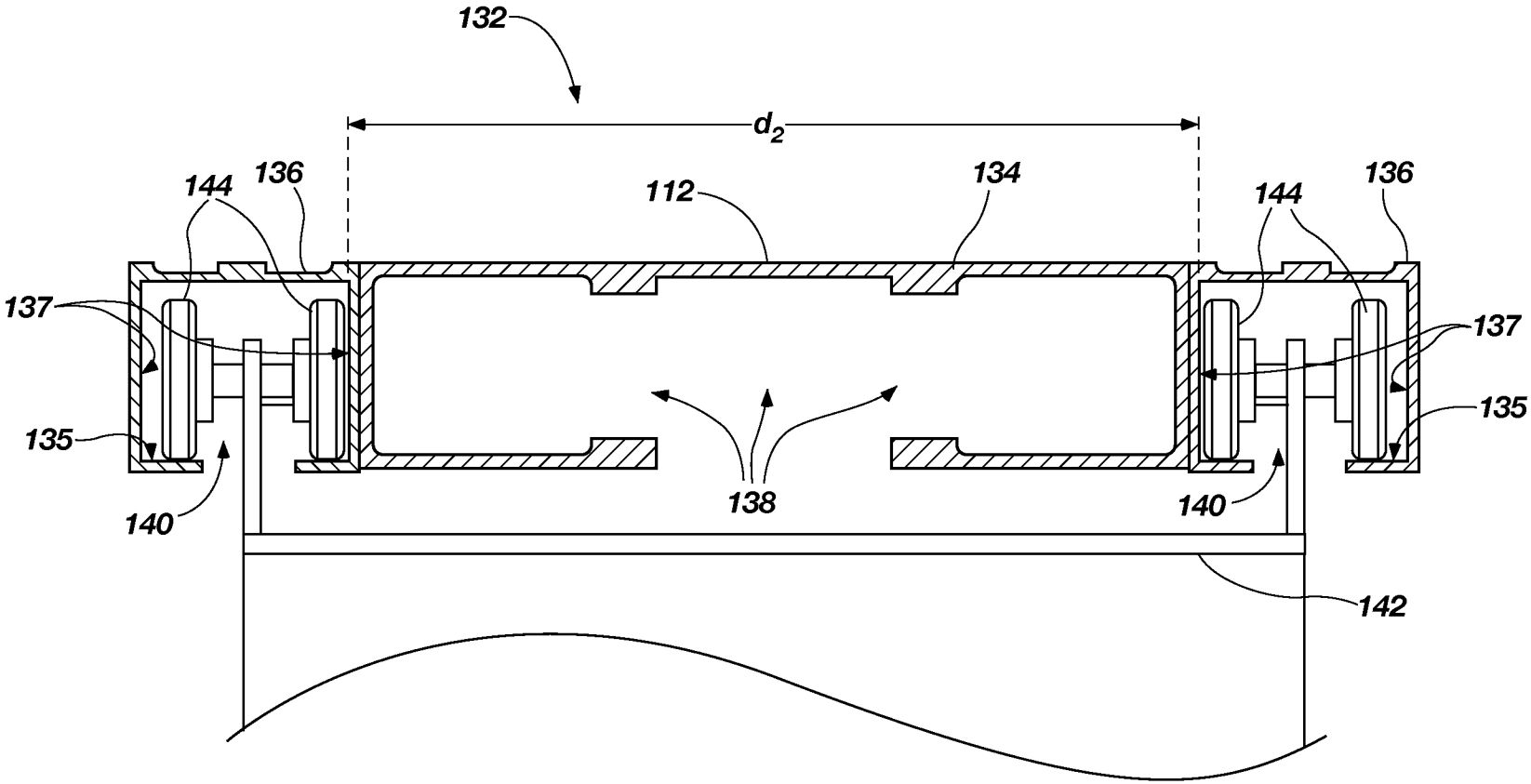
FIG. 3 is a partial cross-sectional view of a support system of the movable partition system of FIG. 1.

Referring to FIG. 3, a support system 132 for the movable partition system 100 (not shown in its entirety) is shown. The support system 132 may comprise the track 112, which may comprise an elongated drive guide member 134 located generally centrally in the track 112, and two elongated roller guide members 136 disposed on opposite lateral ends of the elongated drive guide member 134. In some embodiments, the drive guide member 134 and roller guide members 136 may comprise separate bodies or structures that are attached to one another, or simply installed proximate one another. In other embodiments, the drive guide member 134 and roller guide members 136 may comprise different regions of a single, unitary body or structure.

The drive guide member 134 may comprise a hollow body having internal surfaces defining a drive channel 138 that extends longitudinally through the drive guide member 134 and is located generally centrally in the track 112. The drive channel 138, also known as an internal channel, defined by the drive guide member 134 may be used to at least partially house rollers (e.g., wheels), drive mechanism components (e.g., an elongated drive member), or other components of the movable partition system 100 (not shown) as known in the art. Each of the roller guide members 136 may also comprise a hollow body having internal surfaces defining internal roller channels 140 that extend longitudinally through each roller guide member 136 and are located at opposing lateral ends of the drive guide member 134. The roller channels 140 may be partially defined by a bottom surface 135 and innermost side surfaces 137 internal to the roller guide members 136. Thus, the bottom and innermost side surfaces 135 and 137, respectively, may define portions of the internal roller channels 140 of the track 112. Portions of the partition system 100, such as, for example, the movable partition 102 and the floating jamb 130 (see FIG. 2), may be suspended from (i.e., hang from) a trolley 142 and move along the track 112 by the rolling of partition support rollers 144 (e.g., wheels or bearings) within and along the roller channels 140 that extend through the roller guide members 136 of the track 112 in a direction at least substantially parallel to a direction of movement of the movable partition 102 (see FIG. 2).

Figure 4:
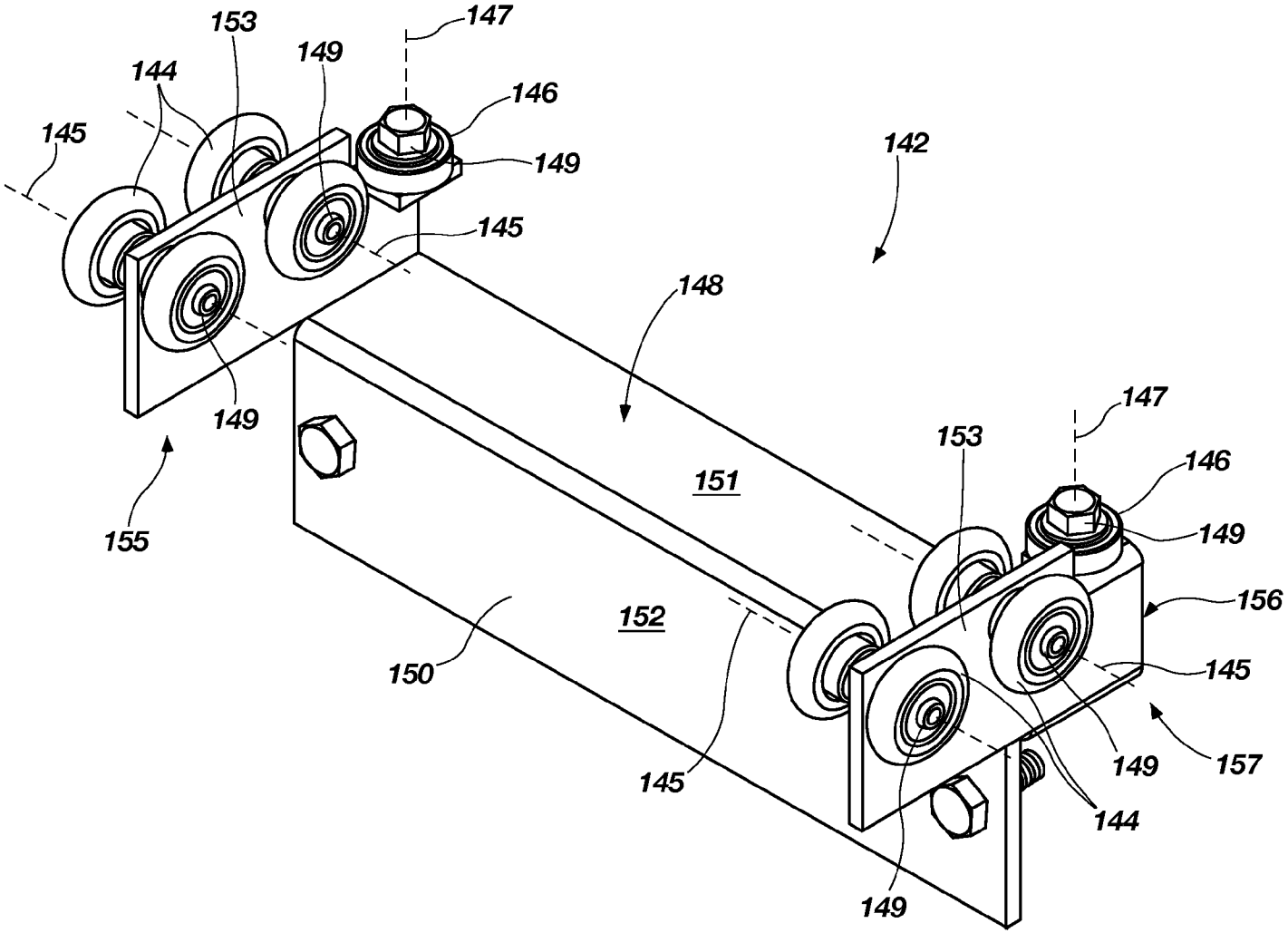
FIG. 4 is a perspective view of a trolley for a partition system.

Referring to FIG. 4, a trolley 142 for a partition system 100 (see FIGS. 1 and 2) is shown. The trolley 142 includes support rollers 144 and guide rollers 146 attached to a frame member 148. The frame member 148 may have a leading end 155 and a trailing end 157. The frame member 148 may include a generally planar portion 151 extending in a direction transverse to a direction in which the partition 102 is configured to move for a distance of at least about a distance $d_2$ between roller channels 140 of the track. The frame member 148, including the generally planar portion 151, may be formed from a generally planar sheet of metal, for example. The frame member 148 may also include roller attachment portions 153 extending generally upwardly from the generally planar portion 151, such as, for example, generally planar sheets of metal that has been bent or folded to extend in an at least substantially upward direction, to which the support rollers 144 and the guide rollers 146 may be attached. Thus, the roller attachment portion 153 may form right angles with the generally planar portion 151. The roller attachment portions 153 may also extend at least substantially horizontally in a plane offset from the plane of the generally planar portion 151, such as, for example, portions of the generally upwardly extending portions that have been bent or folded to extend in an at least substantially horizontal direction above the generally planar portion 151, where the guide rollers 146 are to be attached.

The support rollers 144 may be sized and configured for insertion into and rolling engagement with a track 112 (see FIG. 3). When installed in a track 122, the support rollers 144 may contact and be rollingly engaged with a bottom surface 135 defining a portion of an internal lateral channel 140 of the track 112. A rotational axis 145 of the support rollers 144 may be oriented in an at least substantially horizontal direction transverse to a direction of movement of the trolley 142 (see FIG. 2). As a partition 102 (see FIG. 2) attached to the trolley 142 is deployed to an extended state, the support rollers 144 may rotate and roll along the bottom surface 135 defining a portion of the internal lateral channel 140 of the track 112, enabling the partition 102 to be deployed using relatively little force. The support rollers 144 may be attached to the frame member 148 using roller attachment hardware 149, such as, for example, pins, bolts, a protrusions on the frame member 148 over which the support rollers 144 may snap, or other means that enable rolling attachment of the support rollers 144 to the frame member 148. The support rollers 144 may comprise, for example, wheels or bearings. In embodiments where the support rollers 144 comprise wheels, the support rollers 144 may also include bearings attached to or formed integrally with the support rollers 144, such as, for example, ball bearings configured to bear the weight of a movable partition 102 and other components of a partition system 100 and other vertical force components acting on the movable partition 102 while enabling the support rollers 144 to rotate. Alternatively, the support rollers 144 may rotate about the roller attachment hardware 149, such as, for example, bolts that also act as axles for the support rollers 144. In addition, the support rollers 144 may be detachable from the frame member 148, enabling a user to swap the support rollers 144 for other support rollers that are compatible with other tracks, such as, for example, standard track sizes and configurations known in the art.

The guide rollers 146 shown in FIG. 4 may also be sized and configured for insertion into and rolling engagement with a track 112 (see FIG. 3). When installed in a track 112, the guide rollers 146 may contact and be rollingly engaged with a side surface 137 defining a portion of an internal lateral channel 140 of the track 112. A rotational axis 147 of the guide rollers 146 may be oriented in an at least substantially vertical direction. The guide rollers 146 may be attached to the frame member 148 using pins, bolts, a snap fit to protrusions on the frame member 148, or other means that enable rolling attachment of the guide rollers 146 to the frame member 148. The guide rollers 146 may comprise, for example, wheels or bearings. In embodiments where the guide rollers 146 comprise wheels, the guide rollers 146 may also include bearings attached to or formed integrally with the guide rollers 146, such as, for example, ball bearings configured to bear horizontal force components acting on the movable partition 102 while enabling the guide rollers 142 to rotate. Alternatively, the guide rollers 146 may rotate about roller attachment hardware 149, such as, for example, bolts, that also act as axles for the guide rollers 146. In addition, the guide rollers 146 may be detachable from the frame member 148, enabling a user to swap the guide rollers 146 for other guide rollers that are compatible with other tracks, such as, for example, standard track sizes and configurations known in the art.

Figure 5:
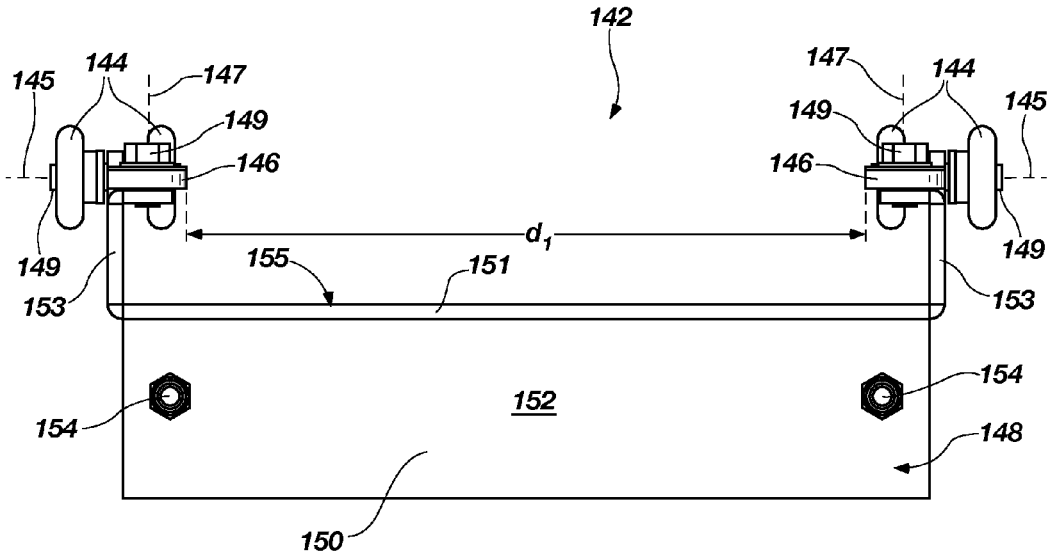
FIG. 5 is a front view of the trolley of FIG. 4.

Referring to FIG. 5, a front view of the trolley 142 of FIG. 4 is shown. The frame member 148 may include a jamb attachment portion 150. The jamb attachment portion 150 may comprise, for example, a generally downwardly extending planar member, such as, for example, a generally planar sheet of metal that has been bent or folded to extend in an at least substantially downward direction. Thus, the jamb attachment portion 150 may form a right angle with the generally planar portion 151. Planar attachment surfaces 152 of the jamb attachment portion 150 may be transverse to surfaces of the roller attachment portions 153. The jamb attachment portion 150 may be configured for attachment to the floating jamb 130 of the partition system 100 (see FIG. 2). Additionally, the jamb attachment portion 150 may be configured for attachment to one or more movable partitions 102 (see FIG. 2). Alternatively, one or more movable partitions 102 may be attached to the floating jamb 130, which may be attached, in turn, to the jamb attachment portion 150 of the trolley 142. The jamb attachment portion 150 may comprise opposing planar attachment surfaces 152 configured to face the movable partition 102 and control box 128, respectively. The jamb attachment portion 150 may also comprise jamb attachment hardware 154, such as, for example, holes with bolts or pins inserted therethrough, to which a floating jamb 130, a movable partition 102, or both may be attached. Thus, portions of the floating jamb 130, the movable partition 102, or both may abut one or more of the planar attachment surfaces 152. The jamb attachment portion 150 may be formed integrally with a remainder of the frame member 148, or may comprise a separate portion that is attached to the frame member 148.

The jamb attachment portion 150, the generally planar portion 151, and the roller attachment portions 153 of the frame member 148 may be formed, for example, from a single sheet of metal that has been bent, folded, cut, or otherwise manipulated to from the frame member 148. Thus, the frame member 148 may be integrally formed from a sheet of metal by cutting, bending, and otherwise manipulating the sheet to form the jamb attachment portion 150, the generally planar portion 151, and the roller attachment portions 153. In other embodiments, at least one of the jamb attachment portion 150, the generally planar portion 151, and the roller attachment portions 153 may be formed separately and attached to the remainder of the frame member 148.

Figure 6:
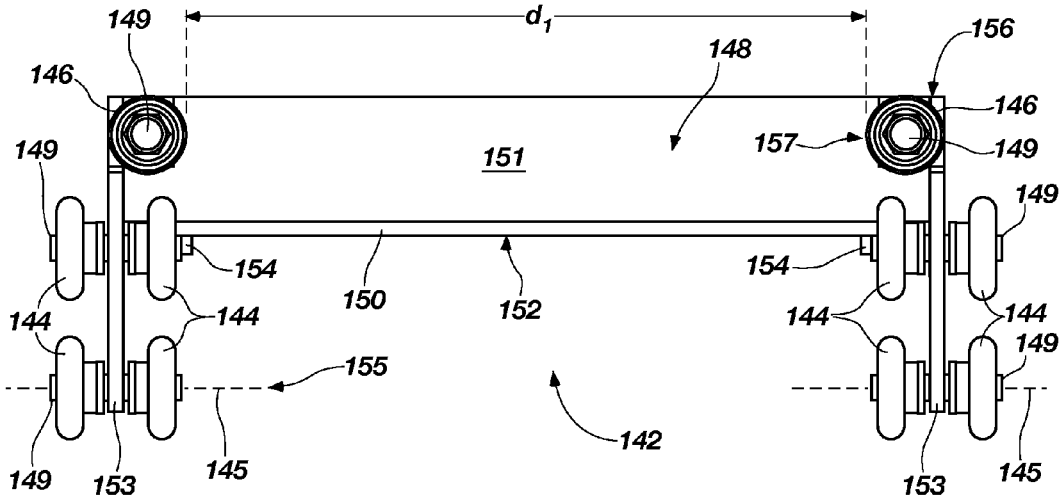
FIG. 6 is a top view of the trolley of FIG. 4.

Referring to FIG. 6, a top view of the trolley 142 of FIG. 4 is shown. The guide rollers 146 may be laterally spaced to provide a distance $d_1$ between innermost portions of the guide rollers 146 that is equal to or slightly greater than another distance $d_2$ between innermost side surfaces 137 defining lateral channels 140 of the track 112 (see FIG. 3). As a partition 102 (see FIG. 2) attached to the trolley 142 is deployed to an extended state, relative movement of the panels 104 and hinge-like members 106, such as, for example, disparities in rates of extension of first and second movable partitions 102A and 102B, may cause the trolley 142 to become askew (e.g., surfaces of the trolley 140 that are normally transverse to a direction of movement of the partition 102, such as the planar attachment surfaces 152, may instead be at an oblique angle to the direction of movement of the partition 102). As portions of the trolley 142, such as, for example, the support rollers 144 or the roller attachment hardware 149 attaching the support rollers 144 to the frame member 148, press against the side surfaces 137 of the lateral channels 140 of the track 112 due to the changed orientation of the trolley 142, the trolley 142 may become stuck or bound in the track 112, preventing full extension of the partition 102. Conventionally, binding of the trolley 142 has been prevented by longitudinally spacing the support rollers 144 at a large distance from one another, such as a distance greater than a thickness t of the control box 128 (see FIG. 2), increasing the longitudinal length of the partition system 100 when in a retracted state and thereby increasing the required depth D of the pocket 108 for storing the partition system 100. By laterally spacing the guide rollers 146 at a distance $d_1$ that is equal to or slightly greater than the distance $d_2$ between innermost side surfaces 137 defining internal lateral channels 140 of the track 112, the guide rollers 146 may prevent or minimize binding of the trolley 142 in the track 112 by preventing the trolley 142 from becoming askew while enabling the support rollers 144 to have a short wheelbase, and thereby reduce the required depth D of the pocket 108 for storing the partition system 100. The overall depth D of the pocket 108 may be reduced by up to six inches (6 in) compared to conventional partition systems.

Figure 7:
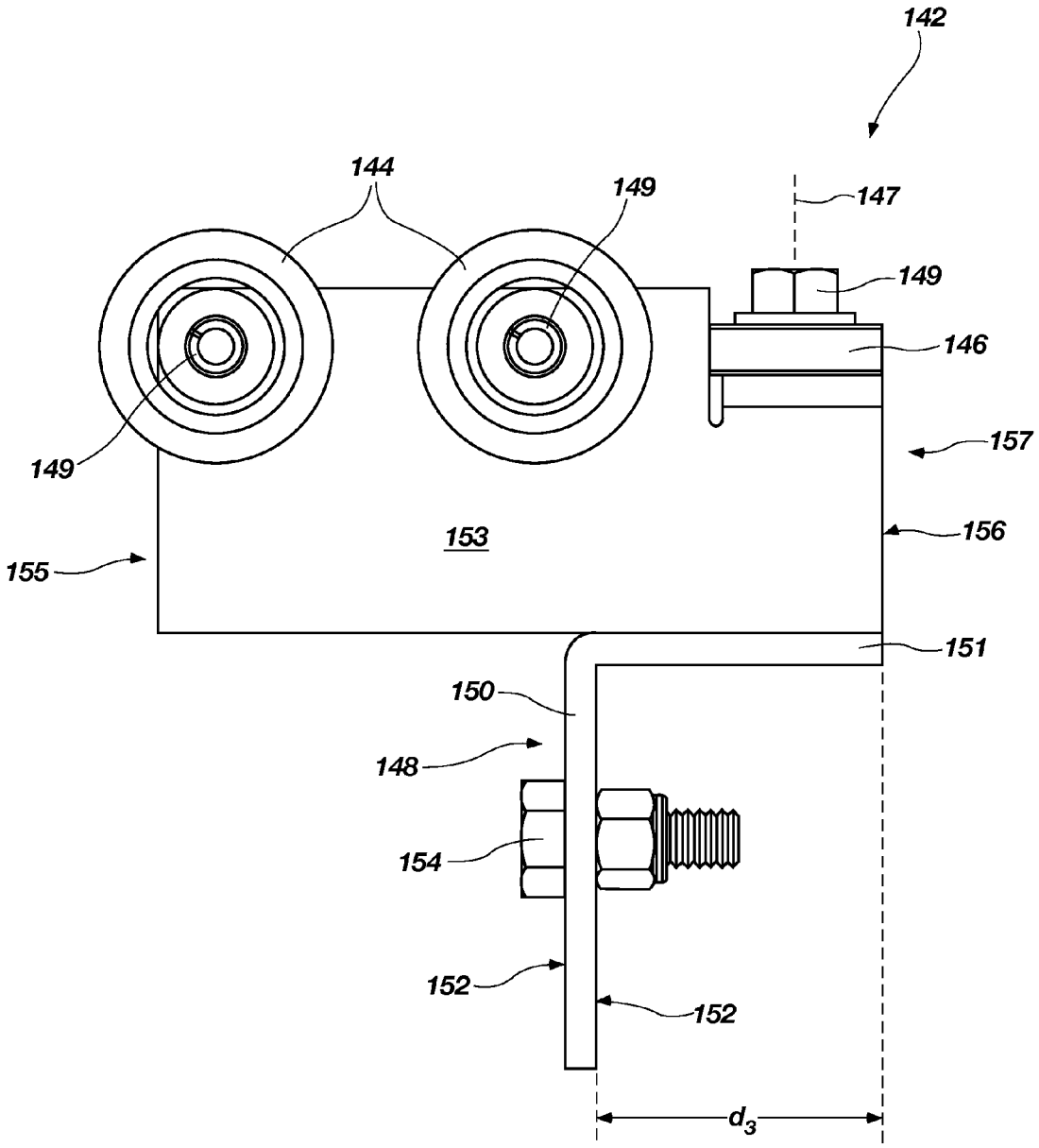
FIG. 7 is a side view of the trolley of FIG. 4.

Referring to FIG. 7, a side view of the trolley 142 of FIG. 4 is shown. A distance $d_3$ between the rearmost planar attachment surface 152 of the jamb attachment portion 150 and a rearmost surface 156 of the frame member 148 may be at least substantially equal to the thickness t of the control box 128 (see FIG. 2). Therefore, the distance $d_3$ may be about three inches (3 in) or less. For example, distance $d_3$ between the rearmost planar attachment surface 152 of the jamb attachment portion 150 and the rearmost surface 156 of the frame member 148 may be three percent greater or smaller (±3%) than three inches (3 in), five percent greater or smaller (±5%) than three inches (3 in), or even ten percent greater or smaller (±10%) than three inches (3 in). In embodiments where the distance $d_3$ between the rearmost planar attachment surface 152 of the jamb attachment portion 150 and the rearmost surface 156 of the frame member 148 is less than three inches (3 in), the distance $d_3$ may be two and three-quarters inches (2.75 in), two and a half inches (2.5 in), two and a quarter inches (2.25 in), two inches (2.0 in), or even less. Thus, the jamb attachment portion 150 may be located three inches (3 in) or less from the rearmost surface 156 of the trailing end 157 of the frame member 148. In some embodiments, the control box 128 may abut the attachment surface 152 and be attached to the jamb attachment portion 150, for example, using the same attachment hardware 154 for attaching the movable partition 102, the floating jamb 130, or both. In such embodiments, a rearmost surface of the control box 128 may be at least substantially flush with the rearmost surface 156 of the frame member 148 of the trolley 142. In other embodiments, the control box 128 may be mounted in the pocket 108, and the rearmost attachment surface 152 may abut the control box 128 when the partition 102 is in a retracted state. Thus, the control box 128 may be at least substantially flush with and may not protrude beyond the rearmost surface 156 of the frame member 148. In this way, the trolley 142 may further reduce the required depth D of the pocket 108 for storing the partition system 100.

As a partition 102 (see FIGS. 1 and 2) is moved into a retracted state, the floating jamb 130, and the trolley 142 to which it is attached, may move within the pocket 108. When fully retracted, the partition 102 may be contained completely within the pocket 108. In embodiments where the control box 128 is attached to the trolley 142, such as, for example, to the jamb attachment portion 150 of the trolley 142, the control box 128 may also move within the pocket 108. When the partition 102 is fully retracted, the control box 128 may contact the rearmost surface of the pocket 108, and may be prevented from moving further into the pocket 108 by the rearmost surface of the pocket 108. In addition, the rearmost surface 156 of the trolley 142 may contact the rearmost surface of the pocket 108 in some embodiments. In embodiments where the control box 128 is not attached to the trolley 142, such as, for example, where the control box 128 is mounted to the rearmost surface of the pocket 108, the trolley 142 and the floating jamb 130 may move toward the control box 128. When the partition 102 is fully retracted, a rearmost surface of the floating jamb 130 or a planar attachment surface 152 of the trolley 142 may contact the control box 128. A rearmost surface 156 of the trolley 156 may be located behind a frontmost surface of the control box 128, and may contact the rearmost surface of the pocket 108 in some embodiments.

When installing a partition system 100 (see FIGS. 1 through 3), a foldable partition 102 may be attached to the floating jamb 130, which may be attached, in turn, to a trolley 142, as described with reference to FIGS. 4 through 7. The floating jamb 130 may be attached to the trolley 142 at the jamb attachment portion 150 using, for example, attachment hardware 154 as described previously. Thus, the floating jamb 130 may be attached to the jamb attachment portion 150 of the frame member 148, which may be located about three inches (3 in) or less from the rearmost surface 156 of the trailing end 157 of the trolley 142. The trolley 142 may be suspended from a track 112. When suspending the trolley 142 from the track 112, the support rollers 144 may be inserted into the internal lateral channels 140 of the track 112 and may rollingly engage a bottom surface 135 defining a portion of the internal lateral channels 140 of the track 112. Further, the guide rollers 146 may also be inserted into the internal lateral channels 140 of the track 112 and may rollingly engage inner side surfaces 137 defining a portion of the internal lateral channels 140 of the track 112. In some embodiments, a control box 128 configured for use with a partition system 100 may be attached to the trolley 142, for example, at the jamb attachment portion 150. When attached, a rearmost surface of the trolley 142 may be aligned at least substantially flush with a rearmost surface 156 of the frame member 148 of the trolley 142.

While the present disclosure has been described herein with respect to certain embodiments, those of ordinary skill in the art will recognize and appreciate that it is not so limited. Rather, many additions, deletions, and modifications to the embodiments described herein may be made without departing from the scope of the disclosure as hereinafter claimed, including legal equivalents. In addition, features from one embodiment may be combined with features of another embodiment while still being encompassed within the scope of the disclosure as contemplated by the inventors.

What is claimed is:

1. A partition system, comprising:

a track;

at least one partition configured to hang from and move along the track, the at least one partition having a leading first end and a second end opposite the first end;

a drive system configured to move the at least one partition along the track;

a control box configured to contain at least a power supply for supplying power to the drive system;

a floating jamb configured to attach to the second end of the at least one partition, the floating jamb capable of drifting and changing position independent of movement of the at least one partition caused by the drive system; and a trolley configured to attach to the floating jamb and rollingly engage with the track, the trolley comprising:

at least one frame member comprising a jamb attachment portion configured to attach to the floating jamb and a rearmost surface located at an end of the at least one frame member opposing an end of the at least one frame member configured to face the at least one partition, a distance between the jamb attachment portion and the rearmost surface of the at least one frame member being less than or equal to a thickness of the control box as measured in a direction at least substantially parallel to a direction of movement of the trolley; and at least one support roller attached to the at least one frame member and configured to engage with the track.

2. The partition system of claim 1, wherein the distance from the jamb attachment portion to the rearmost surface of the at least one frame member is about three inches or less.

3. The partition system of claim 2, wherein the distance from the jamb attachment portion to the rearmost surface of the at least one frame member is three inches plus or minus five percent.

4. The partition system of claim 1, further comprising:

at least one guide roller attached to the at least one frame member and configured to rollingly engage with an internal side surface within a channel of the track.

5. The partition system of claim 4, wherein the at least one guide roller comprises a plurality of guide rollers, at least two guide rollers of the plurality of guide rollers being laterally spaced by a distance equal to or slightly greater than another distance between innermost side surfaces defining channels of the track.

6. The partition system of claim 5, wherein the at least two guide rollers are configured to prevent binding of the trolley in the track.

7. The partition system of claim 1, wherein the control box is attached to the at least one frame member.

8. The partition system of claim 7, wherein a surface of the control box is at least substantially flush with the rearmost surface of the at least one frame member opposite the second end.

9. The partition system of claim 1, wherein the drive system is carried by the at least one partition.

10. The partition system of claim 1, wherein the floating jamb is configured to be located in a pocket formed in a wall.

11. The partition system of claim 1, wherein the at least one frame member comprises a plurality of members collectively forming the at least one frame member.

12. The partition system of claim 1, wherein the track comprises a plurality of elongate members.

13. A method of installing a partition system, comprising:

attaching at least one foldable partition to a floating jamb at a trailing end of the at least one foldable partition, the trailing end opposing a leading end of the at least one foldable partition, the at least one foldable partition being suspended from and movable along a track;

connecting the at least one foldable partition to a drive system configured to move the at least one foldable partition along the track, the drive system being electrically connected to a power supply located within a control box;

attaching the floating jamb to a jamb attachment portion of a frame member of a trolley, a rearmost surface of the trolley being located at a trailing end of the frame member opposing an end of the frame member facing the at least one partition, a distance between the jamb attachment portion and the rearmost surface of the frame member being less than or equal to a thickness of the control box as measured in a direction at least substantially parallel to a direction of movement of the trolley; and suspending the trolley from the track by rollingly engaging at least one support roller of the trolley with the track to render the floating jamb capable of drifting and changing position independent of movement of the at least one partition caused by the drive system.

14. The partition system of claim 13, wherein attaching the floating jamb to the frame member of the trolley at the jamb attachment portion of the frame member comprises attaching the floating jamb to the jamb attachment portion located three inches plus or minus five percent from the rearmost surface of the trolley.

15. The method of claim 13, further comprising:

attaching the control box to the frame member of the trolley.

16. The method of claim 15, wherein attaching the control box to the frame member of the trolley comprises aligning a rearmost surface of the control box at least substantially flush with the rearmost surface of the trolley.

17. The method of claim 13, wherein suspending the trolley from the track further comprises:

rollingly engaging at least one guide roller of the trolley with an internal lateral side surface within a channel of the track.

* * * * *